US005895898A

United States Patent [19]

Godesa

[11] Patent Number: 5,895,898

[45] Date of Patent: Apr. 20, 1999

[54] DEVICE FOR MUTUALLY LOCKING THE ACTUATION OF AT LEAST TWO POWER SWITCHES

[75] Inventor: Ludvik Godesa, Berlin, Germany

[73] Assignee: Siemens Aktiengesellschaft, München, Germany

[21] Appl. No.: 08/817,838

[22] PCT Filed: Oct. 30, 1995

[86] PCT No.: PCT/DE95/01522

§ 371 Date: Aug. 14, 1997

§ 102(e) Date: Aug. 14, 1997

[87] PCT Pub. No.: WO96/13843

PCT Pub. Date: May 9, 1996

[30] Foreign Application Priority Data

Oct. 31, 1994 [DE] Germany ..... 44 39 745

[51] Int. Cl.[6] ..... H01H 9/26; H01H 3/26

[52] U.S. Cl. ..... 200/50.32; 218/154

[58] Field of Search ..... 200/50.02, 50.05, 200/50.25, 50.32, 50.4, 400, 401, 331; 307/119; 218/154

[56] References Cited

U.S. PATENT DOCUMENTS

| | | | |
|---|---|---|---|
| 4,400,599 | 8/1983 | Rickmann | 200/50.36 |
| 4,703,137 | 10/1987 | Bohnen et al. | 200/50.25 |
| 4,788,453 | 11/1988 | Bohnen et al. | 307/119 |
| 4,968,861 | 11/1990 | Kuhn | 200/400 |

FOREIGN PATENT DOCUMENTS

| | | | |
|---|---|---|---|
| 2480993 | 10/1981 | France | H01H 9/26 |
| 3611020 | 10/1987 | Germany | H01H 9/26 |
| 3841315 | 6/1989 | Germany | H01H 9/26 |
| 4002936 | 11/1991 | Germany | H01H 9/26 |
| 4409172 | 9/1994 | Germany | H01H 9/26 |
| 1199074 | 7/1970 | United Kingdom | H01H 9/26 |

*Primary Examiner*—J. R. Scott
*Attorney, Agent, or Firm*—Kenyon & Kenyon

[57] ABSTRACT

A device for mutually locking the actuation of at least two power switches. The device includes an energy accumulator, such as a spring, assigned to each of the power switches and loaded by the rotation of a switching shaft, to thereby actuate a flexible transmission leading to an evaluation apparatus which can prevent actuation of one of the switches. The energy accumulator improves the reliability of the mechanical locking mechanism and allows a lighter transmission to be used. Plural switches may be locked or activated by connecting two flexible transmissions to a single switching shaft and to two different evaluation apparatuses.

4 Claims, 2 Drawing Sheets

DEVICE FOR MUTUALLY LOCKING THE ACTUATION OF AT LEAST TWO POWER SWITCHES

BACKGROUND OF THE INVENTION

1. Field of the Invention

The present invention concerns a device for mutually locking the actuation of at least two power switches, with the position of a switching shaft of each power switch being supplied, via a mechanical transmission, to a mechanical evaluation apparatus, which releases or locks the actuation of the power switch.

2. Description of the Prior Art

A locking device of this type has been disclosed by German Patent 44 09 172 A1. The transmission means described therein are wire triggers or sheathed-wire Bowden controls, which may be of considerable length in some switching systems. Depending on the arrangement of the power switches to be mutually locked, it may also be necessary to arrange the flexible transmission means with a plurality of bends with different curvatures. It has been found that actuating the flexible transmission means consumes a surprisingly high amount of energy, although tests performed on the Bowden controls or wire triggers have found little friction.

It is also known that a system of tie rods can be used for mutually locking power stitches (German Patents 38 41 315 A1 and 44 09 172 A1). Also in these devices, it was found that actuation required considerable amounts of energy.

SUMMARY OF THE INVENTION

The object of the present invention is therefore to reduce the energy consumption of a locking device and thus to improve and facilitate the construction of mutual locking arrangements for a plurality of power switches.

This object is achieved according to the invention by providing each power switch with an energy accumulator for actuating the mechanical transmission, which is loaded by the rotation of the switching shaft in the ON direction. There is arranged, between the energy accumulator and the switching shaft, a dead travel coupling that works during the rotation of the switching shaft from the ON position to the OFF position. The attached evaluating apparatus has a restoring spring that acts upon the transmission.

In the arrangement according to the present invention, the energy accumulator has the property of decoupling the switching shaft of the power switch from the mechanical transmission. Thus the motion of the transmission is not rigidly dependent on the rotation of the switching shaft as in the previously customary direct coupling. This prevents the transmission from being subjected to jerks by the sudden rotation of the switching shaft of the power switch, which result in high stresses at the connecting point between the transmission and the switching shaft. If flexible transmission with a curvature are used, a strong increase in friction between the transmission and its sheathing is avoided through the increase in the motion time due to the energy accumulator. Therefore, it has been found that even power switches located several meters away can be locked.

The same advantageous decoupling of the switching shaft rotation from the actuation of a transmission is achieved when the power switch is switched OFF by the aforementioned dead travel coupling. The restoring spring provides smooth motion during return to the original position.

A helical compression spring having one end that can be attached to a lever connected to the switching shaft and another end that is connected to the mechanical transmission is particularly well suited as an energy accumulator. By selecting a suitable spring, both the desired decoupling as described above and sufficient actuating force can be achieved.

If the evaluating apparatuses are to be affected by two power switches, position reports from one power switch should be transmitted to the other two power switches. An embodiment of the arrangement according to the present invention having two simultaneously loading energy accumulators for actuating mechanical transmissions means is well suited for this purpose.

The switching shaft of power switches runs across the operating front in the conventional design of the power switches and can be accessed on the side walls. It is advantageous in this case to attach the evaluation apparatus and one or more of the energy accumulator on a carrying plate mounted on the side of the power switch. If this is a withdrawable power switch, the carrying plate is conveniently attached to one of the withdrawable racks accommodating the power switch. If the power switch has a shock-protection design, it is recommended to provide shock protection even when a position sensor according to the invention is installed. For this purpose, an insulating shaft coupling can be arranged in a side wall, made of insulating material, of the power switch for connection of a switching shaft made of conducting material and an actuating shaft loading the energy accumulators, with the actuating shaft detachably engaging the shaft coupling.

BRIEF DESCRIPTION OF THE DRAWINGS

The invention is explained in detail below using the embodiments illustrated in the drawing.

DETAILED DESCRIPTION OF THE INVENTION

Figure 1:
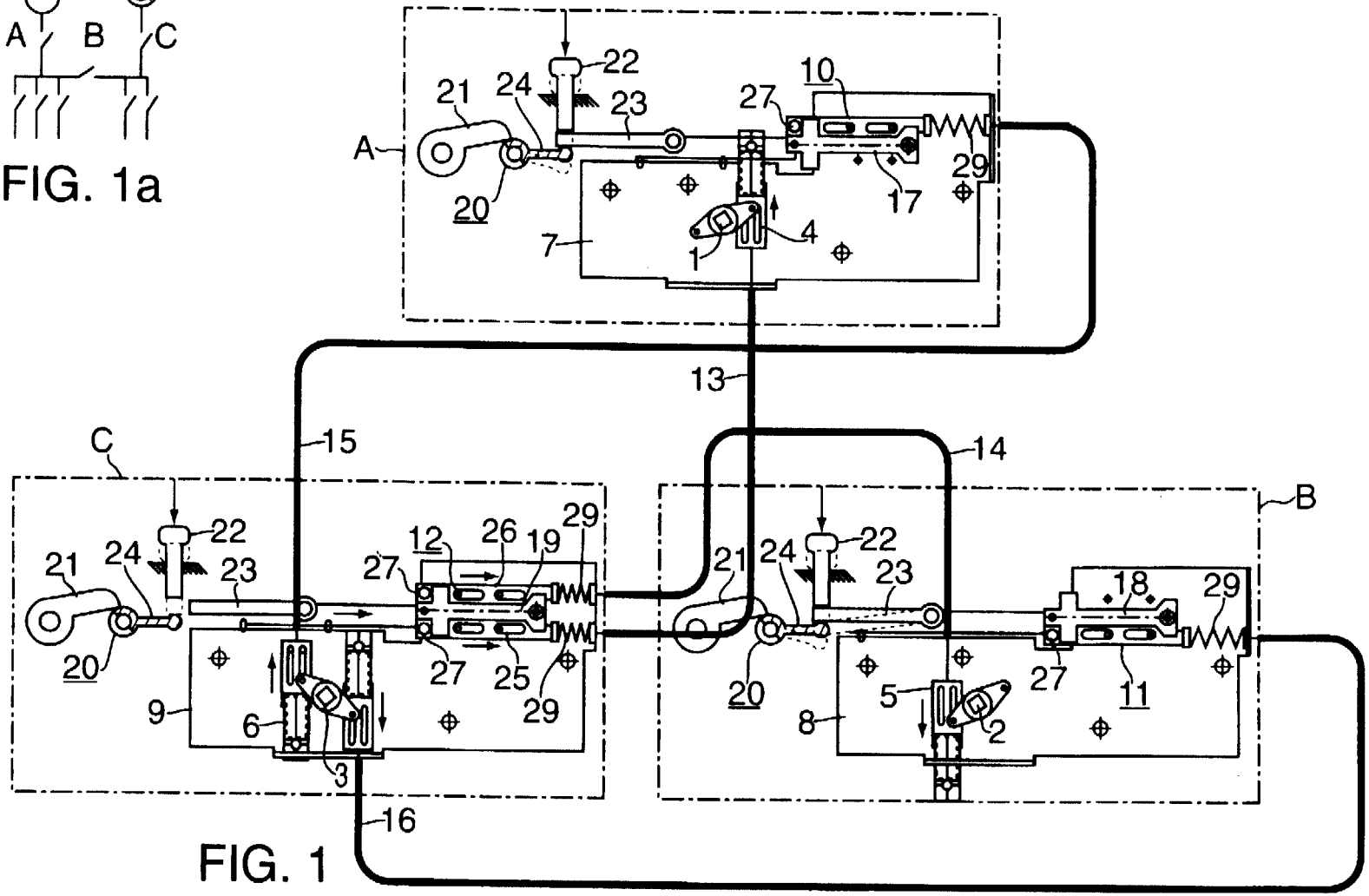
FIG. 1 schematically shows a device for mutually locking three power switches.
Figure 1A:
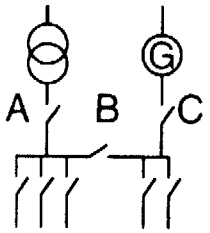
FIG. 1*a* is an electrical schematic of the switches of FIG. 1.

FIG. 1 shows three power switches A, B, and C with in dot-and-dash lines. The ends of actuating shafts 1, 2, and 3 of position indicators 4, 5, 6 that detect the position of power switches A, B, and C are shown as a rectangle. Furthermore, each power switch A, B, C has a carrying plate 7, 8, 9, supporting both position indicators 4, 5, 6, and the respective evaluation apparatuses 10, 11, 12, working as receivers. A flexible transmission 13 goes from position indicator 4 to evaluation apparatus 12 of power switch C. In a basically identical arrangement, a flexible transmission 14 of position indicator 5 connects power switch B to the evaluation apparatus 12 of power switch C. Position indicator 6 of power switch C has two outputs. One of these is connected to evaluation apparatus 10 of power switch A via flexible transmission 15, and the other is connected to evaluation apparatus 11 of power switch B via a transmission 16. Thus there are a total of four flexible transmissions.

Regarding the operation of evaluation apparatuses 10, 11, and 12, each of these has an output slide 17, 18, 19, respectively, which works together with a schematically illustrated switching-on latch mechanism, which has a switching-on semishaft 20 and a switching-on latch 21, supported by semishaft 20. The switching-on semishaft 20 can be rotated to release switching-on latch 21, via ON pushbutton 22, only when it engages a locking slide 23 connected to output slides 10, 11 and 12 between the ON pushbutton 22 and an extension 24 mounted on switching-on shaft 20. If locking slide 23 is withdrawn, as is the case of power switch C in FIG. 1, the ON pushbutton 22 cannot reach extension 24. Therefore power switch C cannot be switched on in the position in FIG. 1.

The purpose of the arrangement illustrated in FIG. 1 can be appreciated better in the wiring diagram shown in the same figure, top left. It shows a switching system with three power switches A, B, and C, a transformer, and a generator. Power switch A is associated with the transformer and power switch C is associated with the generator. The third power switch B serves as a coupling switch within a bus bar, which can be supplied either from the transformer via power switch A or from the generator via power switch C. This results in the condition that power switch C must be locked against switching on if power switches A and B are closed. Conversely, power switch A and B should be prevented from switching on if power switch C is closed.

Coupling units 27 are responsible for ensuring that position indicators 4, 5, and 6 act on the respective output slides 17, 18, and 19 of evaluation apparatuses 10, 11, and 12. FIG. 1 illustrates the status when power switches A and B are on and can be switched and power switch C is locked against switching on. This is done by position indicator 4 actuating an input slide 25 of evaluation apparatus 12 via transmission 13, thus drawing away locking slide 23 from extension 24. Actuating power switch B via position indicator 2 and transmission 14 acting on a second input slide 26 of evaluation apparatus 12 has the same effects. A detailed description of the above-described mechanism is given in the application entitled EVALUATION APPARATUS FOR A POWER SWITCH MUTUALLY LOCKING SYSTEM, based on PCT/DE95/01518 and filed on even date herewith.

Although the illustration of FIG. 1 is schematic, it shows the layout of the flexible transmissions having a plurality of curves, which may have different and relatively sharp curvatures, which agrees well with experience. Despite this fact, a surprisingly smooth, and thus more reliable, operation of the device is achieved through the special design of position indicators 10, 11, and 12, which will be described in more detail with reference to FIGS. 2 and 3.

Figure 3:
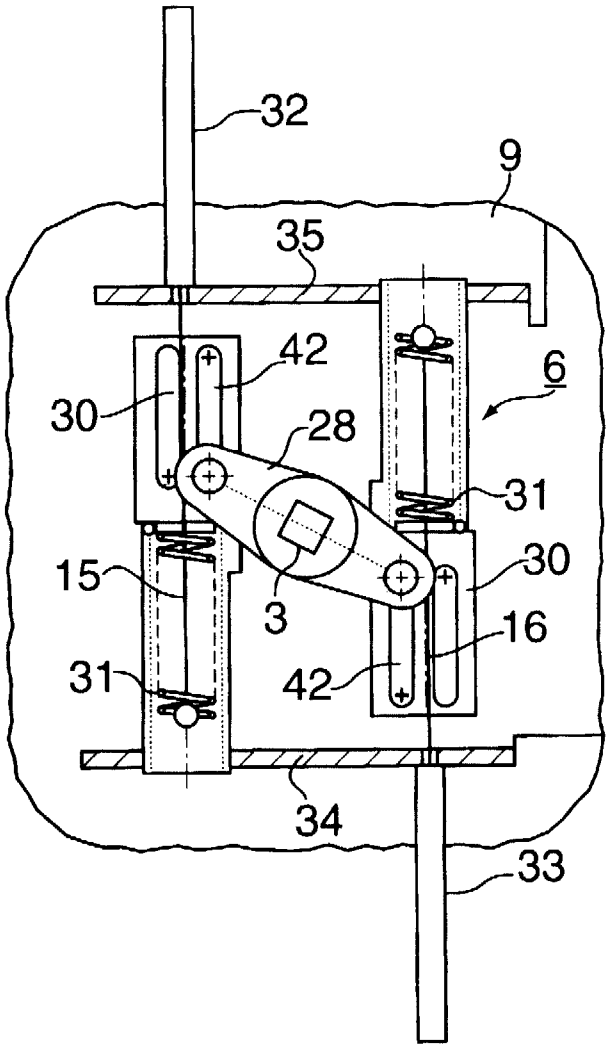
FIGS. 2 and 3 show a dual energy accumulator of a power switch to be actuated by two flexible transmissions in two views that are perpendicular to one another.
Figure 2:
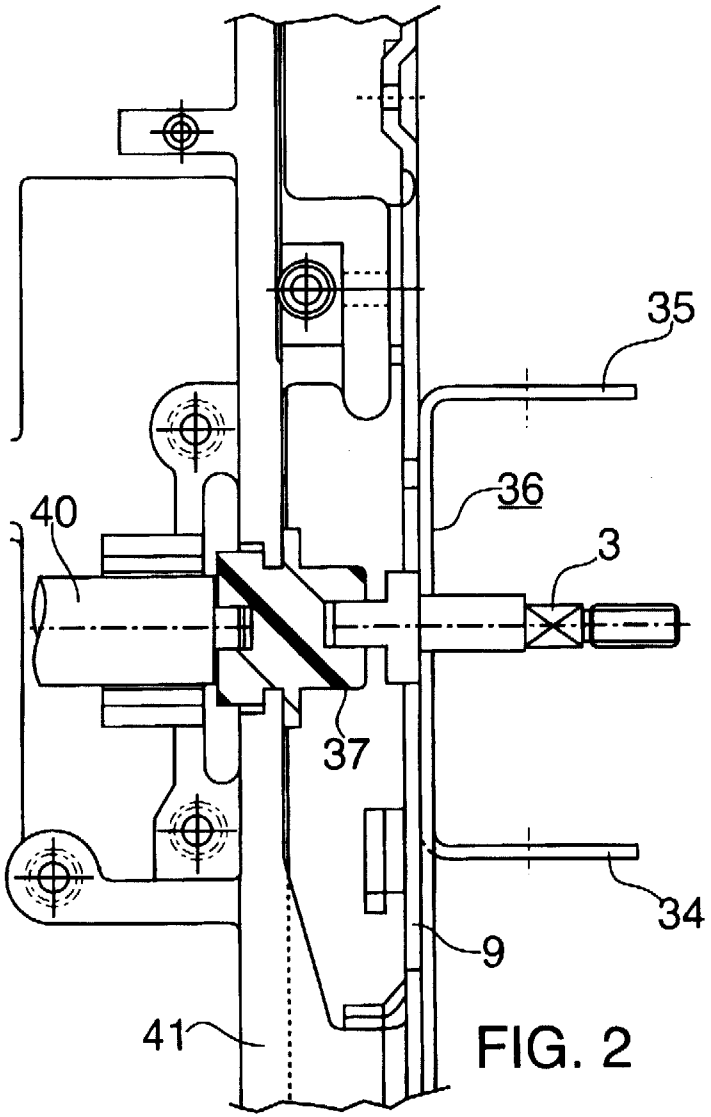

FIGS. 2 and 3 show position indicator 6, which functionally corresponds to position indicators 4 and 5. A symmetrical two-armed lever 28, with each arm articulatedly connected to a slide 30, is mounted on actuating shaft 3. Each of slides 30 serves as an abutment of an energy accumulator 31 in the form of a helical compression spring, which at the other end engage flexible transmissions 15 and 16. Sheathings 32 and 33 of flexible transmissions 15 and 16, respectively are supported by legs 34 and 35 of a supporting yoke 36, on which slides 30 are guided in opposite directions.

If only one transmissions is required for reporting the position of a power switch, as in the case of power switches A and B, the position indicator is provided with only one slide 30, as is the case of position indicators 4 and 5.

For the desired function it is essential that the extremely jerky rotation of actuating shaft 3 be decoupled from the flexible transmission means 15 and 16 by first loading energy accumulators 31. If the spring strength is properly selected, which is done by simple trial and error, both reliable operation of evaluation apparatuses 10, 11, and 12, and low-loss transmission of the motion of actuating shaft 3 to evaluation apparatuses 10 and 11 is achieved. The considerably reduced stress compared to direct actuation of the flexible transmissions allows lighter and therefore easier-to-arrange flexible transmissions. The input slides of evaluation apparatuses 10, 11, and 12 have restoring springs 29 to bring the device back into the initial position (FIG. 1). These are responsible for the smooth actuation of transmissions 13, 14, or 16, independently of both actuating shafts 1, 2, or 3 and the respective switching shafts of the corresponding power switches A, B, or C. This is done by enabling the respective actuating shafts 1, 2, or 3 to execute a no-load stroke due to a longitudinal bore 42 in each of slides 30 (FIG. 3). Slide 30 is then drawn back into the initial position by restoring spring 29 acting at the other end of the respective transmissions (FIG. 3).

FIG. 2 also shows that position indicator 6 is attached to carrying plate 9, which is in turn arranged according to the design of the respective power switch C. In particular, carrying plate 9 is attached to power switch C if it is installed in a fixed position. On the other hand, if power switch C is in a withdrawable rack, then carrying plate 9 is attached to the withdrawable rack. A rotatable coupling between switching shaft 40 and actuating shaft 4 is created by a detachable shaft coupling 37, which is mounted at the end of a switching shaft 40 of power switch C. Shaft coupling 37 is open on the side in order to allow power switch 1 to automatically engage when it is inserted in its withdrawable rack. To ensure that power switch C (and similarly power switches A and B also provided with position indicators) remains shock-proof, switching shaft 40 ends inside the housing made of insulating material, whose side wall 41 facing position indicator 6 is partly visible in FIG. 3. Shaft coupling 37 is also made of an insulating material and prevents users from touching switching shaft 40 made of an electrically conductive material.

As mentioned previously, the required strength of the compression spring used as energy accumulator 31 can be easily determined by trial and error. This is also true for restoring spring 29. It must be noted, however, that restoring spring 29 should be considerably weaker than energy accumulator 31, since its task consists merely of moving the respective input slide, the Bowden control or a rod assembly used as a flexible transmission and slide 30 of the respective position indicator back to their initial positions. Also in this case the motion is smooth and low-friction, since return to the initial position is decoupled from the still jerky rotation of switching shaft 40.

What is claimed is:

1. A mutual locking device comprising:

at least two power switches, each of the at least two power switches including at least one rotating switching shaft, at least one mechanical evaluation apparatus, at least one slide, and at least one lever, each switching shaft being connected to at least one of the slides by at least one of the levers, the mechanical evaluation apparatuses releasing and locking actuation of the power switches, each power switch including at least one energy accumulator loaded by rotation of an associated switching shaft to an on position, the energy accumulators including helical compression springs, each slide including a longitudinal bore acting as a dead travel coupling during rotation of the switching shaft from the on position to an off position, the at least one dead travel coupling being arranged between one of the energy accumulators and one of the switching shafts; and a plurality of mechanical transmission members, each mechanical transmission member being connected to at least one of the slides and at least one of the mechanical evaluation apparatuses, one end of each helical compression spring being connected to at least one slide and another end of each helical compression spring being connected to one of the mechanical transmission members, each energy accumulator actuating at least one of the mechanical transmission members, the position of the at least one switching shaft of each of the power switches being supplied to at least one of the mechanical evaluation apparatuses through at least one of the mechanical transmission members, each mechanical evaluation apparatus including an energy restoring spring acting upon one of the mechanical transmission members.

2. The device according to claim 1, wherein:

at least one of the power switches includes two energy accumulators loaded simultaneously, the two energy accumulators acting upon the evaluation apparatuses of two power switches through two mechanical transmissions.

3. The device according to claim 1, further comprising:

a carrying plate mounted on at least one power switch, and wherein at least one of the mechanical evaluation apparatuses and at least one position indicator is attached to the carrying plate.

4. The device according to claim 1, further comprising:

an insulating shaft coupling, made of an insulating material, mounted on at least one power switch, the insulating shaft coupling coupling one of the switching shafts and an actuating shaft connected to one of the energy accumulators, and wherein the actuating shaft coupled to the one of the switching shafts can be detachably engaged through the shaft coupling.

* * * * *